US006902247B2

(12) United States Patent
Vanhooydonck et al.

(10) Patent No.: US 6,902,247 B2
(45) Date of Patent: Jun. 7, 2005

(54) MULTI-RESOLUTION PRINTING METHOD AND PRINTING DEVICE

(75) Inventors: Rudi Vanhooydonck, Zwijndrecht (BE); Patrick Van den Bergen, Hove (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/411,476

(22) Filed: Apr. 10, 2003

(65) Prior Publication Data

US 2003/0210292 A1 Nov. 13, 2003

Related U.S. Application Data

(60) Provisional application No. 60/382,363, filed on May 22, 2002.

(30) Foreign Application Priority Data

May 8, 2002 (EP) ..... 02100468

(51) Int. Cl.[7] ..... B41J 29/38
(52) U.S. Cl. ..... 347/12; 347/41
(58) Field of Search ..... 347/12, 15, 37, 347/40, 41

(56) References Cited

U.S. PATENT DOCUMENTS 5,359,355 A * 10/1994 Nagoshi et al. ..... 347/9
5,788,385 A * 8/1998 Inoue et al. ..... 400/279
5,975,679 A 11/1999 Nicoloff, Jr. et al. ..... 347/43
6,014,153 A 1/2000 Harvey ..... 347/71

FOREIGN PATENT DOCUMENTS

| | | |
|---|---|---|
| EP | 0 277 703 A1 | 8/1988 |
| EP | 02 10 0468 | 10/2002 |
| WO | WO 96/10488 | 4/1996 |
| WO | WO 99/12738 | 3/1999 |

* cited by examiner

*Primary Examiner*—Lamson Nguyen
*Assistant Examiner*—Blaise Mouttet
(74) *Attorney, Agent, or Firm*—John A. Merecki; Robert A. Sabourin

(57) ABSTRACT

A method and apparatus of printing an image onto a medium uses a system having an elongate printhead with an array of marking elements including at least one distinctive group. The marking elements form at least one row, the direction of which forms a longitudinal axis of the printhead. The printhead is driven in a fast scan direction to print marks on the medium along a swath, and the medium and the printhead are movable relative to each other in a slow scan direction to print further swaths. The system is such that two adjacent marking elements of a group are operable with a time difference but are not operable simultaneously without causing defects. The printhead operates to print parallel lines at a non-zero angle with respect to the longitudinal axis of the printhead. Printing passes are repeated in the fast scan direction to print at intermediate positions between the parallel lines to print the complete image.

12 Claims, 5 Drawing Sheets

MULTI-RESOLUTION PRINTING METHOD AND PRINTING DEVICE

The application claims the benefit of U.S. Provisional Application No. 60/382,363 filed May 22, 2002.

DETAILED DESCRIPTION OF THE PREFERRED EMBODIMENTS

Field of the Invention

The present invention relates to apparatus and methods for printing and in particular to drop-on-demand (DOD) inkjet printing methods and apparatus.

BACKGROUND OF THE INVENTION

When DOD inkjet is considered, two main groups can be discerned: thermal inkjet and piezo inkjet.

With thermal inkjet technology, tiny resistors rapidly heat a thin layer of liquid ink. The heated ink causes a vapour bubble to be formed, expelling or ejecting drops of ink through nozzles and placing them precisely on a surface to form text or images. As the bubble collapses, it creates a vacuum that pulls in fresh ink. This process is repeated thousands of times per second. With thermal inkjet technology, water-based inks are used.

Piezoelectric printing technology—commonly called piezo—pumps ink through nozzles using pressure, like a squirt gun. A piezo crystal used as a very precise pump places ink onto the printing medium. A wide range of ink formulations (solvent, water, UV) may be used.

In heads used for high resolution printing, nozzles are located close to each other. Different nozzles next to each other suffer from cross-talk, both thermal cross-talk and mechanical cross-talk. The most severe form of cross-talk is mechanical cross-talk generated by using a common wall or shared wall between two nozzles, as explained hereinafter.

A number of different piezo concepts exist.

A typical concept, as described in U.S. Pat. No. 4,887,100, WO 96/10488, WO 97/04963 and WO 99/12738, all herein incorporated by reference in their entirety for background information, uses so called shared walls. The pressure chambers containing the ink are next to each other, while their dividing walls are the actuators.

Because an actuator is always shared by two channels, it is not possible to jet a drop out of two neighbouring channels at the same time. In WO 96/10488 is described that the nozzles are divided in three interlaced groups (A, B, C). Neighbouring nozzles are fired in a sequence ABC. Two solutions are possible to print dots on a straight line.

A first solution uses a complete nozzle array under a certain angle. By doing this, the resolution is increased, and by using the right fast scan speed, dots fired in a sequence A, B, C are on a straight line.

A second solution uses a head perpendicular to the fast scan direction, in which the A, B, and C nozzles are staggered in the is fast scan direction. Printing of a line of pixels is divided into three cycles. In the first cycle, the dividing walls to either side of the A channels are driven (if ink is to be ejected from them—depending on the image to be printed) with a pulsed signal. In the second cycle, the dividing walls to either side of the B channels are driven (if ink is to be ejected from them—depending on the image to be printed) with a pulsed signal. In the third cycle, the dividing walls to either side of the C channels are driven (if ink is to be ejected from them—depending on the image to be printed) with a pulsed signal. The pressure pulses developed in the channels that are not included in the current cycle are not larger than ½ of those in the channels that are intended to eject ink. The printing apparatus is arranged so that such pulses with ½ magnitude do not cause ink ejection.

A drawback of this concept is that, once the firing frequency is defined, only one fast scan speed can be used to print ABC dots on a straight line, as explained hereinafter. In the fast scan direction, the head will e.g. print each 1/360-inch.

FIG. 1 shows a piezo printhead 10 according to the prior art, having nozzles 12 which are divided into three sets, called a set of A nozzles, a set of B nozzles and a set of C nozzles, each set intended to be fired during different firing cycles. The different sets of nozzles are staggered with respect to each other over a stagger distance D1 in the fast scan direction. If the nozzles are divided in groups G of three, every first nozzle is part of the set of A nozzles, every second nozzle is part of the set of B nozzles and every third nozzle is part of the set of C nozzles. All nozzles in one set A, B, C are positioned on a straight line in the slow scan direction S, which lines are located at the stagger distance D1 with respect to each other in the fast scan direction F.

As an example, printhead 10 is considered to be a type 360 head. This means that the printhead 10 is provided for printing 360 dpi (=pixels per inch) in the fast scan direction F. In this type 360 printhead 10, the distance D1 between nozzles 12 in the fast scan direction F is 1/360 inch/3=70.56 μm/3=23.52 μm.

If the firing frequency is 12.4 kHz, meaning that every set A, B, C of nozzles can be fired every 80.65 μs, the speed of the printhead 10 in the fast scan direction F is 1/360 inch*12.4 kHz=0.875 m/s. The nozzles 12 are fired in an ABC sequence, with the A nozzles at the leading edge of the printhead 10 in the fast scan direction F.

The cycle frequency is 12.4 kHz*3=37.2 kHz. Or formulated in another way: the set of B nozzles fires 26.88 μs after the set of A nozzles, and the set of C nozzles fires 53.76 μs after the set of A nozzles. After 80.65 μs, the set of A nozzles fires again.

When it would be desired to keep the same firing frequency, but to print a 180*180 dpi image with the 360 type printhead of the example given above, the printhead speed should theoretically double to 1.750 m/s. In the above case of printing a 180*180 dpi image with a 360 type printhead, where the printhead speed must double to 1.750 m/s, the delays for firing B and C need to be shorter to make sure that dots are printed on the same line. Nozzle set B has to be fired 13.44 μs after nozzle set A, and nozzle set C 26.88 μs after nozzle set A. These firing frequencies are too close one to the other, and therefore a 360 type printhead cannot be used to print a 180*180 dpi image.

When it would be desired, on the other hand, to print a 720*720 dpi image with the 360 type printhead, the firing delay between the set of A nozzles, set of B nozzles and set of C nozzles increases to 53.76 μs. As, however, after 80.65 μs the set of A nozzles has to fire again, there is not enough time left to fire the set of C nozzles, and therefore a 360 type printhead cannot be used to print a 720*720 dpi image neither.

It is an object of the present invention to provide a method and device for printing, with one type of printhead, with a resolution which is different from the design resolution of the type of printhead used.

It is an object of the present invention to provide a method and device for printing, with one type of printhead, a variety of resolutions.

SUMMARY OF THE INVENTION

The above objects are achieved by a method of printing an image onto is a printing medium using a printing system with an elongate printhead having an array of marking elements (A, B, C, A, B, C) comprising at least one group (G) of marking elements (A, B, C), the marking elements forming at least one row, the direction of the row forming a longitudinal axis of the printhead, the printhead being driven in a fast scan direction (F) to print marks on the printing medium along one swath of print in one pass, and the printing medium and the printhead being movable relative to each other in a slow scan direction (S) to print further swaths, and the printing system being such that two adjacent marking elements of a group (G) are firable with a time difference T but are not firable simultaneously without causing a printing defect, wherein the printhead is operated such that adjacent marking elements of one group (G) are firable (depending on an image to be printed) at instants of time separated by the time T to form a series of parallel lines of print at a non-zero angle with respect to the longitudinal axis of the printhead and also at a non-zero angle with respect to the fast scan direction, which series of parallel lines do not form a complete part of the image, and repeating printing passes in the fast scan direction (F) to print at intermediate positions between the parallel lines to print the complete part of the image. The image may be formed of a superposition of monochromatic sub-images (called separations) in which case the repeating of the printing passes relates to each monochromatic sub-image. The marking elements (A, B, C) of one group (G) may be staggered with respect to each other over a stagger distance (D1) in the fast scan direction (F) to form a plurality of rows (6, 7, 8) of marking elements, the printhead being intended to be driven with a reference velocity ($V_{ref}$), the method including operating the printhead at an operating velocity (V) which is different from the reference velocity ($V_{ref}$). The reference velocity ($V_{ref}$) is equal to the stagger distance (D1) multiplied by a reference firing frequency ($F_{ref}$). One marking element of a group is able to be fired at each reference firing frequency pulse (whether it fires depends upon the image to be printed). The marking elements of the print head are intended to be fired according to a reference firing order to print an image with a first resolution. When printing with the designed reference velocity and firing frequency parallel lines of print are produced which are parallel to the longitudinal axis of the printhead. The method may include delaying printing data representing the image supplied to some of the marking elements with respect to the printing data supplied to other marking elements.

The present invention also provides a printing device with an elongate printhead having an array of marking elements (A, B, C, A, B, C) comprising at least one group (G) of marking elements (A, B, C), the marking elements forming at least one row, the direction of the row forming a longitudinal axis of the printhead, the printhead being intended to be driven in a fast scan direction (F) to print marks on the printing medium along one swath of print in one pass, and the printing medium and the printhead being movable relative to each other in a slow scan direction (S) to print further swaths, and the printing device being such that two adjacent marking elements of a group (G) are firable with a time difference T but are not firable simultaneously without causing a printing defect, further comprising means for operating the printhead such that adjacent marking elements of one group (G) are firable (depending on the image to be printed) at instants of time separated by the time T to form a series of parallel lines of print at a non-zero angle with respect to the longitudinal axis of the printhead and also at a non-zero angle with respect to the fast scan direction, which series of parallel lines do not form a complete part of the image, and comprising means for repeating printing passes in the fast scan direction (F) to print at intermediate positions between the parallel lines to print a complete part of the image. The marking elements (A, B, C) of one group (G) can be staggered or not staggered with respect to each other. Means for delaying printing data representing the image supplied to some of the marking elements with respect to the printing data supplied to other marking elements may be provided. Means for shifting the printing medium with respect to the printhead between printing passes may also be provided.

The present invention also provides a control unit for a printer for printing an image onto a printing medium using a printing system having an elongate printhead having an array of marking elements (A, B, C, A, B, C) comprising at least one group (G) of marking elements (A, B, C), the marking elements forming at least one row, the direction of the row forming a longitudinal axis of the printhead, the control unit being adapted to control the driving of the printhead in a fast scan direction (F) to print in one pass marks on the printing medium along one swath of print, and for controlling the movement of the printing medium and the printhead relative to each other in a slow scan direction (S) to print further swaths, the printing system being such that two adjacent marking elements of a group (G) are firable with a time difference T but are not firable simultaneously without causing a printing defect, the control unit furthermore being adapted for controlling the driving of the printhead such that adjacent marking elements of one group (G) are firable (depending on an image to be printed) at instants of time separated by the time T to form a series of parallel lines of print at a non-zero angle with respect to the longitudinal axis of the printhead and also at a non-zero angle with respect to the fast scan direction, which series of parallel lines do not form a complete part of the image, and for controlling repeating of printing passes in the fast scan direction (F) to print at intermediate positions between the parallel lines to print a complete part of the image. The marking elements (A, B, C) of one group (G) may be staggered with respect to each other over a stagger distance (D1) in the fast scan direction (F) to form a plurality of rows of marking elements, the printhead being intended to be driven with a reference velocity ($V_{ref}$) and the control unit being adapted to control the driving of the printhead at an operating velocity (V) which is different from the reference velocity ($V_{ref}$). The control unit furthermore may be adapted to delay printing data representing the image supplied to some of the marking elements with respect to the printing data supplied to other marking elements. The control unit may furthermore be adapted to shift the printing medium with regard to the printhead between printing passes.

The present invention also provides a computer program product for executing any of the methods of the invention when executed on a computing device associated with a printhead. The present invention also comprises a machine readable data storage device storing the computer program product. The present invention also includes transmission of the computer program product over a local or wide area telecommunications network.

The present invention will now be described with reference to the attached drawings.

DETAILED DESCRIPTION OF THE INVENTION

Figure 1:
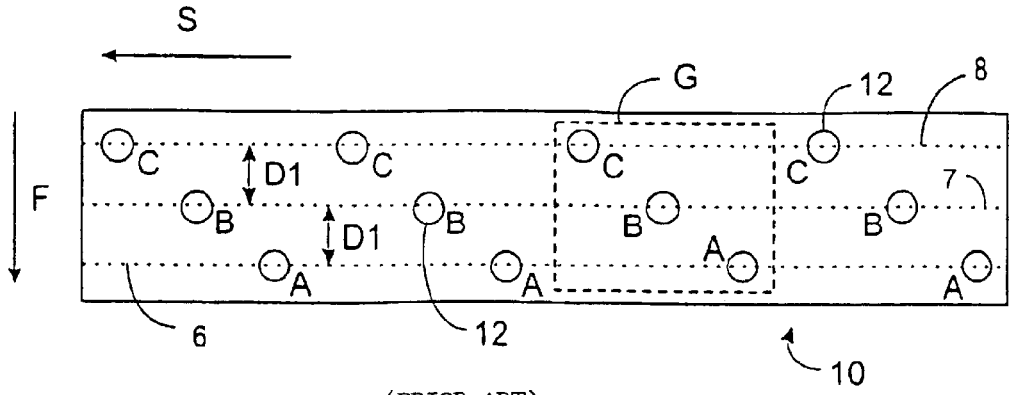
(PRIOR ART) Fig. 1
FIG. 1 is a front view of a printhead with staggered marking elements as known in the prior art.

The present invention will be described with reference to various embodiments and drawings but the present invention is not limited thereto but only by the claims.

The term "printing" as used in this invention should be construed broadly. It relates to forming markings whether by ink or other materials or methods onto a printing substrate. Various printing methods which may be used with the present invention are described in the book "Principles of non-impact printing", J. L. Johnson, Palatino Press, Irvine, 1998, e.g. thermal transfer printing, thermal dye transfer printing, deflected ink jet printing, ion projection printing, field control printing, impulse ink jet printing, drop-on-demand ink jet printing, continuous ink jet printing. Non-contact printing methods are particularly preferred. However, the present invention is not limited thereto. Any form of printing including dots or droplets on a substrate is included within the scope of the present invention, e.g. piezoelectric printheads may be used to print polymer materials as used and described by Plastic Logic (http://plasticlogic.com/) for the printing of thin film transistors. Hence, the term "printing" in accordance with the present invention not only includes marking with conventional staining inks but also the formation of printed 2-D or 3-D structures or areas of different characteristics on a substrate. On example is the printing of water repellent or water attractive regions on a substrate in order to form an off-set printing plate by printing. Accordingly, the term "printing medium" or "printing substrate" should also be given a wide meaning including not only paper, transparent sheets, textiles but also flat plates or curved plates which may be included in or be part of a printing press. In addition the printing may be carried out at room temperature or at elevated temperature, e.g. to print a hot-melt adhesive the printhead may be heated above the melting temperature. Accordingly, the term "ink" should also be interpreted broadly including not only conventional inks but also solid materials such as polymers which may be printed in solution or by lowering their viscosity at high temperatures as well as materials which provide some characteristic to a printed substrate such as information defined by a structure on the surface of the printing substrate, water repellence, or binding molecules such as DNA which are spotted onto micro-arrays. As solvents both water and organic solvents may be used. Inks as used with the present invention may include a variety of additives such as ant-oxidants, pigments and cross-linking agents.

In the following the invention will be described with respect to one type of printing, e.g. ink jet printing in which a printhead traverses with respect to a printing medium in a first direction (fast scan direction) while the print medium indexes forwards relative to the printhead in a direction perpendicular to this (slow scan direction). The present invention is particularly useful for printing heads having a plurality of marking elements and with which firing of marking elements is prevented by the system or would cause a printing defect. This type of head can be an ink jet printing head. If there are shared walls between the nozzles of the head it is not possible to fire two adjacent at the same time. This is an extreme example of what in general might be called crosstalk between adjacent marking elements. In many printing heads there may be some effect on one firing marking element if the adjacent marking element fires at the same time. Such crosstalk may be caused by thermal (e.g. spread of heat energy and therefore change of temperature), mechanical (e.g. shock waves propgating through the head), fluid (e.g. pressure pulses in the ink supply) or electrical (e.g. current to flow through one heating element leaks to an adjacent heating element, an electric field generated by applying a voltage to one electrode of a first marking element may generate an electric field at an electrode of an adjacent marking element) effects for example. These effects may reduce or increase, for example, ink drop size or cause some other type of printing defect. This defect may be that at least one of the adjacent marking elements does not print at all (which is the case for ink jet printheads with common walls), or that at least one of them prints with a defect. For example, for at least one of the marks printed onto a printing medium, the size or intensity of the mark is at least 5% more or less than the intended mark size or density if both marking elements for are actuated at the same time. Also included within the present invention is that the printing system prevents simultaneous firing of adjacent marking elements even if such a firing could be made. In a system designed not to print with adjacent marking elements simultaneously, any such simultaneous firing is a printing defect in accordance with the present invention and the attached claims. With respect to any of the embodiments of the invention below the printhead and the printing system may be of the above type, i.e. that simultaneous firing of adjacent marking elements is prevented.

In a method according to embodiments of the present invention, the speed in the fast scan direction is set at a particular velocity or changed from a reference velocity with which the printhead is intended to be driven (in case of printheads with staggered marking elements) to a particular velocity, while preferably keeping the firing frequency of the sets of nozzles unchanged. This is done in order to be able to print, with a printhead of a certain type, which is intended to print images with a certain resolution, images with other resolutions.

First Embodiment: Staggered Head With Three Marking Elements in a Group

A printhead 10 used according to the first embodiment has a number of sets of marking elements, e.g. three sets of marking elements or nozzles 12: a set of A-nozzles, a set of B-nozzles and a set of C-nozzles. This means that there are three nozzles 12 in one group G, as represented in FIG. 1. Each of the sets of nozzles form a row 6, 7, 8, the direction of which forms a longitudinal axis of the printhead 10.

For a printhead 10 intended to print images of a certain basic resolution, changing the operating velocity makes it possible to print images with a resolution which is higher than the basic resolution, if the printhead passes a plurality of times over the same swath.

For example a type 360 head is considered, which means that this printhead is provided for printing 360 dpi (=pixels per inch) in the fast scan direction F. In this type of printhead 10, the distance D1 between nozzles 12 in the fast scan direction F is 1/360 inch/3=70.56 μm/3=23.52 μm. If the reference firing frequency $F_{ref}$ for this type of head is 12.4 kHz, meaning that every set A, B, C of nozzles can be fired every 80.65 μs, the reference speed $V_{ref}$ of the printhead 10 in the fast scan direction F is 1/360 inch*12.4 kHz=0.87 m/s. The nozzles 12 are fired in an ABC sequence, with the A nozzles at the leading edge of the printhead 10 in the fast scan direction F. The cycle frequency is 12.4 kHz*3=37.2 kHz, or thus the set of B nozzles fires 26.88 μs after the set of A nozzles, and the set of C nozzles fires 53.76 μs after the set of A nozzles. After 80.65 μs, the set of A nozzles fires again. That way, a 360 dpi image is obtained.

According to an embodiment of the present invention, such a type 360 head 10 with a stagger distance D1 of $V_{ref}*T_{ref}$=23.52 μm between two neighbouring sets of nozzles ($T_{ref}=1/F_{ref}$), can be used for printing images with a higher resolution. For example for printing the image at 1080 dpi, the fast scan speed must be double the reference velocity (i.e. 1.75 m/s) and the printhead has to pass 6 times over the same swath.

Figure 2:
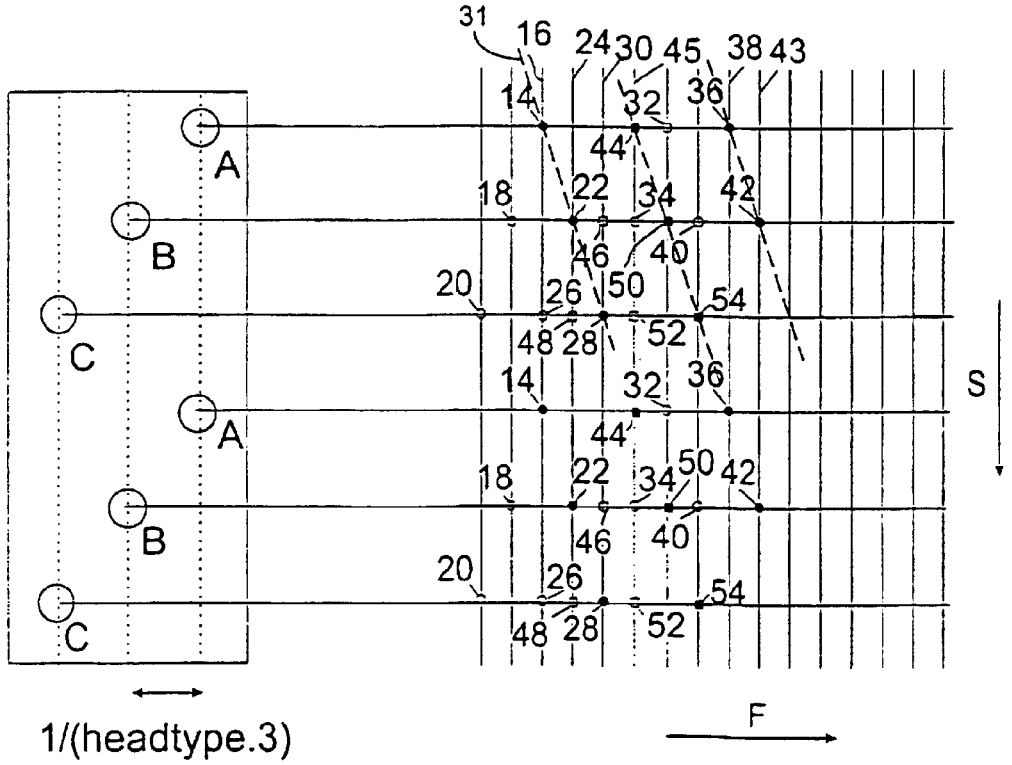
FIG. 2 schematically illustrates a printing scheme of a printhead of FIG. 1, according to an embodiment of the present invention.

If the example of the above type 360 head for printing images in 1080 dpi is worked out further, the following is obtained, as illustrated in FIG. 2.

During a first cycle of a first pass of the printhead 10 over a swath of the print medium, the set of A nozzles is driven first. Where necessary (according to the image to be printed), A nozzles eject drops on locations 14 on a straight line 16 in the slow scan direction S. Drops ejectable during the first pass of the printhead 10 over the print medium (because the nozzles are firable), are indicated in FIG. 2 by black circles. Whether or not they are fired depends on the image to be printed. Locations above which nozzles are located at certain moments in time during the first pass of printhead 10 over the print medium, but where no drops are printed because the respective nozzles are not firable there, are indicated by means of white circles in FIG. 2. At the moment of firing the set of A nozzles, the set of B nozzles is located at locations 18 at a distance $V_{ref}*T_{ref}/3$=23.52 μm behind the set of A nozzles, and the set of C nozzles is located at locations 20 at a distance $2*V_{ref}*T_{ref}/3$=47.04 μm behind the set of A nozzles. Before firing the set of B nozzles, the printhead 10 is moved, with a velocity V which equals for example twice the reference velocity $V_{ref}$, and which is thus 1.75 m/s for the example given, during a time which equals $T_{ref}/3$. Before firing the set of B nozzles, the printhead 10 is thus moved over a distance $V*T_{ref}/3=2*V_{ref}*T_{ref}/3$=47.04 μm in the fast scan direction F. During the first cycle, the set of B nozzles eject drops on locations 22 on a straight line 24 in the slow scan direction S, where necessary according to the image to be printed. At the moment of firing the set of B nozzles, the set of C nozzles is located at locations 26 at a distance of 23.52 μm behind the set of B nozzles. Before firing the set of C nozzles, the printhead 10 is moved over a distance of 47.04 μm in the fast scan direction F. During the first cycle, the set of C nozzles eject drops on locations 28 on a straight line 30 in the slow scan direction S, where necessary according to the image to be printed. It can be seen from FIG. 2 that the droplets from adjacent marking elements fired during one pass form lines of print 31 at a non-zero angle with respect to the longitudinal axis of the printhead 10.

At the moment of firing the set of C nozzles, the set of A nozzles is located at locations 32 at a distance of 47.04 μm in front of the set of C nozzles, and the set of B nozzles is located at locations 34 at a distance of 23.52 μm behind the set of A (or 23.52 μm in front of the set of C nozzles). Before firing the set of A nozzles during a second cycle of the same first pass of the printhead 10, the printhead 10 is moved over a distance of $V*T_{ref}/3=2*V_{ref}*T_{ref}/3$=47.04 μm in the fast scan direction F. During the second cycle, the set of A nozzles eject drops on locations 36 on a straight line 38 in the slow scan direction S, where necessary according to the image to be printed. At the moment of firing the set of A nozzles, the set of B nozzles is located at locations 40 at a distance of 23.52 μm behind the set of A nozzles. Before firing the set of B nozzles, the printhead 10 is moved over a distance of 47.04 μm in the fast scan direction F. The set of B nozzles eject drops on locations 42 on a straight line 43 in the slow scan direction S, where necessary according to the image to be printed.

The above printing scheme is continued in the same way during the first pass of the printhead 10 over the print medium.

During a second pass of the printhead 10 over the same swath of the print medium, drops can be printed (according to the image content) as indicated in FIG. 2 by means of black squares. Locations above which the nozzles are located at certain moments in time during the second pass, but where no drops are printed because the nozzles are not firable there, are indicated by means of white squares.

During a first cycle of the second pass of the printhead 10 over the print medium, the set of A nozzles is driven first. Where necessary (according to the image), A nozzles eject drops, for example on locations 44 on a straight line 45 in the slow scan direction S. At the moment of firing the set of A nozzles, the set of B nozzles is located at locations 46 at a distance 23.52 μm behind the set of A nozzles, and the set of C nozzles is located at locations 48 at a distance $2*V_{ref}*T_{ref}/3$=47.04 μm behind the set of A nozzles. Before firing the set of B nozzles, the printhead 10 is moved, with a velocity V which equals for example twice the reference velocity $V_{ref}$, and which is thus 1.75 m/s for the example given, during a time which equals $T_{ref}/3$. Before firing the set of B nozzles, the head 10 is thus moved over a distance 47.04 μm in the fast scan direction F. During the first cycle, the set of B nozzles ejects a drop on locations 50, where necessary according to the image to be printed. At the moment of firing the set of B nozzles, the set of C nozzles is located at locations 52 at a distance of 23.52 μm behind the set of B nozzles. Before firing the set of C nozzles, the head 10 is moved over a distance of 47.04 μm in the fast scan direction F. During the first cycle of the second pass, the set of C nozzles eject drops on locations 54, where necessary according to the image to be printed.

The above printing scheme is continued, as explained before, during the second pass of the printhead 10 over the print medium.

After six passes, carried out as described above, and each time shifted a little bit so as to write on intermediate positions, the whole image is written, with a resolution of 1080 dpi.

From the above, or from considering the result on FIG. 2, it is clear that print data must be reorganised or "shuffled" so that the correct data is presented to the relevant nozzle at the right time.

Figure 3:
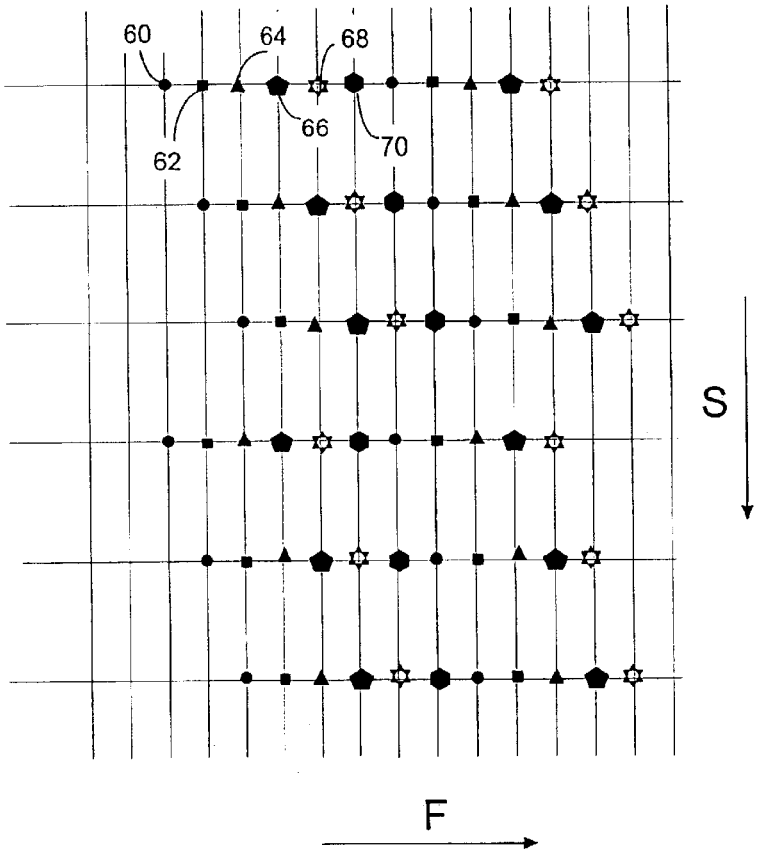
FIG. 3 schematically illustrates which dots of an image are written during each of a plurality of printing passes in order to completely fill out the image in accordance with an embodiment of the present invention.

Although in FIG. 2, dots 44 written with the A nozzles during the second pass of the printhead 10 over a swath are written right in the middle between two dots 14, 36 written with the A nozzles during the first pass, in reality those locations will generally be different. This is shown in FIG. 3: during a first pass, dots are written on locations 60 indicated with circles; during a second pass, dots are written on locations 62 indicated with squares; during a third pass, dots are written on locations 64 indicated with triangles; during a fourth pass, dots are written on locations 66 indicated with pentagons; during a fifth pass, dots are written on locations 68 indicated with stars; and during a sixth pass, dots are written on locations 70 indicated with hexagons. As can be seen in FIG. 3, after six passes, all intermediate locations are filled out (if needed according to the image content), and the desired image is written in a higher resolution than the resolution the printhead was intended for.

The above can be put in general formulae. X (in dpi) is the resolution the printhead is intended for, and Y (in dpi) is the resolution the printhead is used for (=the resolution of the printed image). T is the time between two consecutive fire pulses of the same nozzle. F is the firing frequency of the printhead, whereby F=1/T. V is the velocity at which the printhead is operated.

As stated above, a printhead is intended to be operated at a reference velocity $V_{ref}$, the nozzles being fired at a reference firing frequency $T_{ref}$. According to the present invention, the head is operated at a velocity V which is different from the reference velocity $V_{ref}$, for example a velocity V which is higher than the reference velocity $V_{ref}$. In the following formulae, every velocity V is defined relative to the reference velocity $V_{ref}$ as follows:

$$RV = \frac{V}{V_{ref}}$$

When putting the above in general formulae, the following is obtained:

the set of A nozzles writes at moments t=k·T, k being an integer the set of B nozzles writes at moments $$t = k \cdot T + \frac{T}{3} = T \cdot \frac{(3 \cdot k + 1)}{3}$$

the set of C nozzles writes at moments $$t = k \cdot T + \frac{2 \cdot T}{3} = T \cdot \frac{(3 \cdot k + 2)}{3}$$

At those times, the following locations are reached:

nozzles A write at positions $$y_A = k \cdot RV \cdot V_{ref} \cdot T = k \cdot RV \cdot \frac{0.0254}{X}$$

knowing that $$V_{ref} = \frac{0.0254}{(X \cdot T)}$$

nozzles B write at positions $$\begin{aligned} y_B &= -\frac{0.0254}{(3 \cdot X)} + RV \cdot V_{ref} \cdot T \cdot \frac{(3 \cdot k + 1)}{3} \\ &= -\frac{0.0254}{(3 \cdot X)} + RV \cdot \frac{0.0254 \cdot (3k + 1)}{3 \cdot X} \\ &= k \cdot RV \cdot \frac{0.0254}{X} + (RV - 1) \cdot \frac{0.0254}{3 \cdot X} \end{aligned}$$

nozzles C write at positions $$\begin{aligned} y_C &= -\frac{0.0254 \cdot 2}{(3 \cdot X)} + RV \cdot V_{ref} \cdot T \cdot \frac{(3 \cdot k + 2)}{3} \\ &= -\frac{0.0254 \cdot 2}{(3 \cdot X)} + RV \cdot \frac{0.0254 \cdot (3k + 2)}{3 \cdot X} \\ &= k \cdot RV \cdot \frac{0.0254}{X} + (RV - 1) \cdot \frac{0.0254 \cdot 2}{3 \cdot X} \end{aligned}$$

The resolution Y of the image written with the concept of the present invention can be calculated out of the following formula:

$$\frac{0.0254}{Y} = y_B - y_A = (RV - 1)\frac{0.0254}{3X}$$

and thus $$Y = \frac{3X}{RV - 1} \tag{1}$$

and thus

This is only valid under the condition that $$y_B - y_A = \left((RV - 1) \cdot \frac{0.0254}{3 \cdot X}\right)$$

is a divider of $$RV \cdot \frac{0.0254}{X}$$

The printhead has to write N times over a swath of the image in order to fill out all dots, whereby N is given by:

$$N = \frac{RV \cdot \frac{0.0254}{X}}{y_B - y_A} = \frac{3RV}{(RV - 1)}$$

with $$RV = 3\frac{X}{Y} + 1$$

calculated out of formula (1). N has to be a natural number.

Second Embodiment

It is also possible to write an image of Y dpi with a head intended to print images of X dpi, by using another velocity and passing another number of times over the same swath. For example, it is possible to write the 1080 dpi image with the 360 dpi head of the first embodiment with a velocity different from twice the reference velocity.

In that case, a factor $c_1$ is defined in such a way that the image can be written at a resolution Y2 so that Y=Y2*$c_1$. Then $$RV = 3\frac{X}{Y_2} + 1 = 3\frac{X}{Y/c_1} + 1 \tag{2}$$

and the printhead is passed $c_1$*N times over the same swath. Again $c_1$*N has to be a natural number, with $$N = \frac{3 \cdot RV}{RV - 1} \tag{3}$$

When replacing RV in equation (3) with the result from equation (2), the following is obtained:

$$\frac{3 \cdot \left(3 \cdot \frac{X}{Y/c_1} + 1\right)}{\left(3 \cdot \frac{X}{Y/c_1}\right)} = N$$

or thus $$3 \cdot \frac{3 \cdot c_1 . X + Y}{3 \cdot c_1 . X} = N$$

or thus or $3 \cdot c_1 \cdot X + Y = N \cdot c_1 \cdot X$ or $Y = X \cdot c_1(N-3)$ with $c_1$*N is a natural number. This means that Y/X has to be a natural number as well, and thus that X has to be a divider of Y, or with other words that it is possible to print any multiple of the head resolution with the method according to the present invention. The printing has to be repeated N times, with $$N = \frac{Y}{X \cdot c_1} + 3$$

and with a relative velocity $$RV = 3\frac{X}{Y/c_1} + 1$$

and with a relative velocity

Data for the sets of B and C nozzles should be reshuffled as follows:

for the B nozzles:

$$\Delta_{AB} = \frac{y_B - y_A}{\left(\frac{0.0254}{Y}\right)} = \frac{(RV-1) \cdot \frac{0.0254}{3 \cdot X}}{\frac{0.0254}{Y}} = \frac{(RV-1) \cdot Y}{3 \cdot X} = \frac{3 \cdot \frac{X \cdot Y}{\frac{Y}{c_1}}}{3 \cdot X} = c_1$$

for the C nozzles:

$$\Delta_{AC} = \frac{2 \cdot (y_B - y_A)}{\left(\frac{0.0254}{Y}\right)} = \frac{2 \cdot (RV-1) \cdot \frac{0.0254}{3 \cdot X}}{\frac{0.0254}{Y}}$$

$$= \frac{2 \cdot (RV-1) \cdot Y}{3 \cdot X} = \frac{2 \cdot 3 \cdot \frac{X \cdot Y}{\frac{Y}{c_1}}}{3 \cdot X}$$

$$= 2 \cdot c_1$$

For the above example (see first embodiment) of printing a 1080 dpi image with a 360 dpi head, the calculations of the second embodiment result in RV=3/2 and N=9.

This means that with a 360 dpi head, an image with a resolution of 1080 dpi can be obtained by (according to the first embodiment) using a velocity which is double of the reference velocity, and by printing 6 times over each swath, or by (according to the second embodiment) using a velocity which is one and a half times the reference velocity, and by printing 9 times over each swath. Also other velocities combined with other numbers of printing passes for one swath are possible.

Third Embodiment: Staggered Head With ϕ Marking Elements in a Group

The above formulae can be formulated more generally for a system using ϕ marking elements in a group, as shown below:

$$RV = \frac{V}{V_{ref}}$$

Times at which the nozzles write:

the set of A nozzles writes at moments t=k·T, k being an integer the set of B nozzles writes at moments $$t = k \cdot T + \frac{T}{\varphi} = T \cdot \frac{(\varphi \cdot k + 1)}{\varphi}$$

the set of C nozzles writes at moments $$t = k \cdot T + \frac{2 \cdot T}{\varphi} = T \cdot \frac{(\varphi \cdot k + 2)}{\varphi}$$

the set of ϕ nozzles writes at moments $$k \cdot T + \frac{(\varphi - 1) \cdot T}{\varphi} = T \cdot \frac{(\varphi \cdot (k+1) - 1)}{\varphi}$$

Locations at which the nozzles write:

nozzles A write at positions $$y_A = k \cdot RV \cdot V_{ref} \cdot T = k \cdot RV \cdot \frac{0.0254}{X}$$

knowing that $$V_{ref} = \frac{0.0254}{(X \cdot T)}$$

nozzles B write at positions $$y_B = -\frac{0.0254}{(\varphi \cdot X)} + RV \cdot V_{ref} \cdot T \cdot \frac{(\varphi \cdot k + 1)}{\varphi}$$

$$= -\frac{0.0254}{(\varphi \cdot X)} + RV \cdot \frac{0.0254 \cdot (\varphi k + 1)}{\varphi \cdot X}$$

$$= k \cdot RV \cdot \frac{0.0254}{X} + (RV - 1) \cdot \frac{0.0254}{\varphi \cdot X}$$

nozzles C write at positions $$y_C = -\frac{0.0254 \cdot 2}{(\varphi \cdot X)} + RV \cdot V_{ref} \cdot T \cdot \frac{(\varphi \cdot k + 2)}{\varphi}$$

-continued $$= -\frac{0.0254 \cdot 2}{(\varphi \cdot X)} + RV \cdot \frac{0.0254 \cdot (\varphi k + 2)}{\varphi \cdot X}$$

$$= k \cdot RV \cdot \frac{0.0254}{X} + (RV - 1) \cdot \frac{0.0254 \cdot 2}{\varphi \cdot X}$$

nozzles ϕ write at positions $$y_\varphi = -\frac{0.0254 \cdot (\varphi - 1)}{(\varphi \cdot X)} + RV \cdot V_{ref} \cdot T \cdot \frac{(\varphi \cdot k + \varphi - 1)}{\varphi}$$

$$= -\frac{0.0254 \cdot (\varphi - 1)}{(\varphi \cdot X)} + RV \cdot \frac{0.0254 \cdot (\varphi k + \varphi - 1)}{\varphi \cdot X}$$

$$= \left((k + 1) \cdot RV - 1\right) \cdot \frac{0.0254}{X} + (1 - RV) \cdot \frac{0.0254}{\varphi \cdot X}$$

The resolution Y of the image written with the concept of the present invention can be calculated from the equation:

$$\frac{0.0254}{Y} = y_B - y_A = (RV - 1) \cdot \frac{0.0254}{\varphi \cdot X}$$

and thus $$Y = \frac{\varphi \cdot X}{RV - 1}$$

and thus

The printhead has to write N times over a swath of the image in order to fill out all dots, whereby N is given by:

$$N = \frac{RV \cdot \frac{0.0254}{X}}{y_B - y_A} = \frac{RV \cdot \frac{0.0254}{X}}{(RV - 1) \cdot \frac{0.0254}{\varphi \cdot X}} = \frac{\varphi \cdot RV}{(RV - 1)}$$

N has to be an integer.

Generally, between every two passes the printing medium will be shifted with regard to the printhead in the slow scan direction S. In the description and drawings given or referenced to above, this shift is done over a distance which is a multiple of the number of nozzles in one group, so that A nozzles always print on the same line in the fast scan direction.

Figure 4:
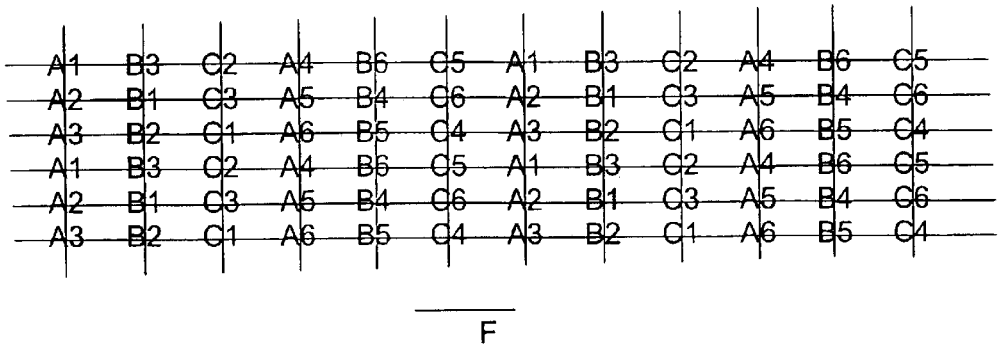
FIG. 4A schematically illustrates an embodiment of the present invention including completely filling out an image by shifting and cyclically rotating the nozzles in case the number of printing passes is a multiple of the number of nozzles in a group, and FIG. 4B schematically illustrates a further embodiment of the present invention completely filling out an image in case the number of printing passes is not a multiple of the number of nozzles in a group.

However, this shift can also be carried out over another distance, not dividable by the number of nozzles in a group. In that case, the firing of the nozzles has to be cyclically rotated. In FIG. 4A, an example is given in which the number of passes (6 in the example) is a multiple of the number of nozzles in a group (3 in the example: A, B, C). Every dot location is labelled with a letter and a number. The letters refer to the nozzles firable at that position, and the numbers refer to the printing passes.

Figure 4B:
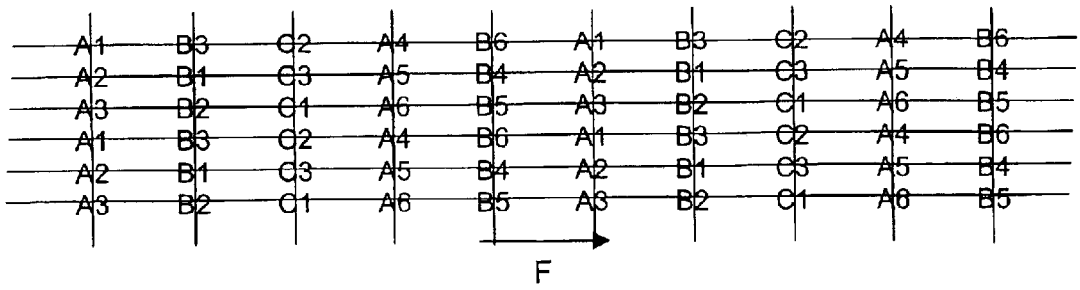

Another possibility is to shift the head over a number of nozzles which is not a multiple of the number of nozzles in a group, and fill out the image in a number of passes which is not a multiple of the number of nozzles in a group. In that case, there are redundant nozzles for some of the dot positions, and some of the nozzles do not write in order not to overwrite already written dots. This is illustrated in FIG. 4B. In the example given, there are 3 nozzles in a group, and 5 passes are needed to completely fill out the image. As can be seen from FIG. 4B, when printing during passes 4, 5 and 6, the locations where nozzles C should print (C4, C5, C6) are already printed during previous passes. Therefore, during passes 4, 5 and 6 the set of C nozzles is not fired.

Fourth Embodiment: Staggered Head at Slower Velocity in Fast Scan Direction

In the previous embodiments the printhead was traversed in the fastscan direction at a speed higher than the reference velocity. However, the present invention also includes traversing the head at a velocity slower than the reference velocity. The resolution achieved can be derived by applying similar methods to those described above. The achieved resolution is given by:

$$Y = \frac{\varphi \cdot X}{|RV - 1|}$$

The printhead has to write N times over a swath of the image in order to fill out all dots, whereby N is given by:

$$N = \frac{\varphi \cdot RV}{|RV - 1|}$$

N has to be an integer.

Fifth Embodiment: No Nozzle Stagger

Figure 5:
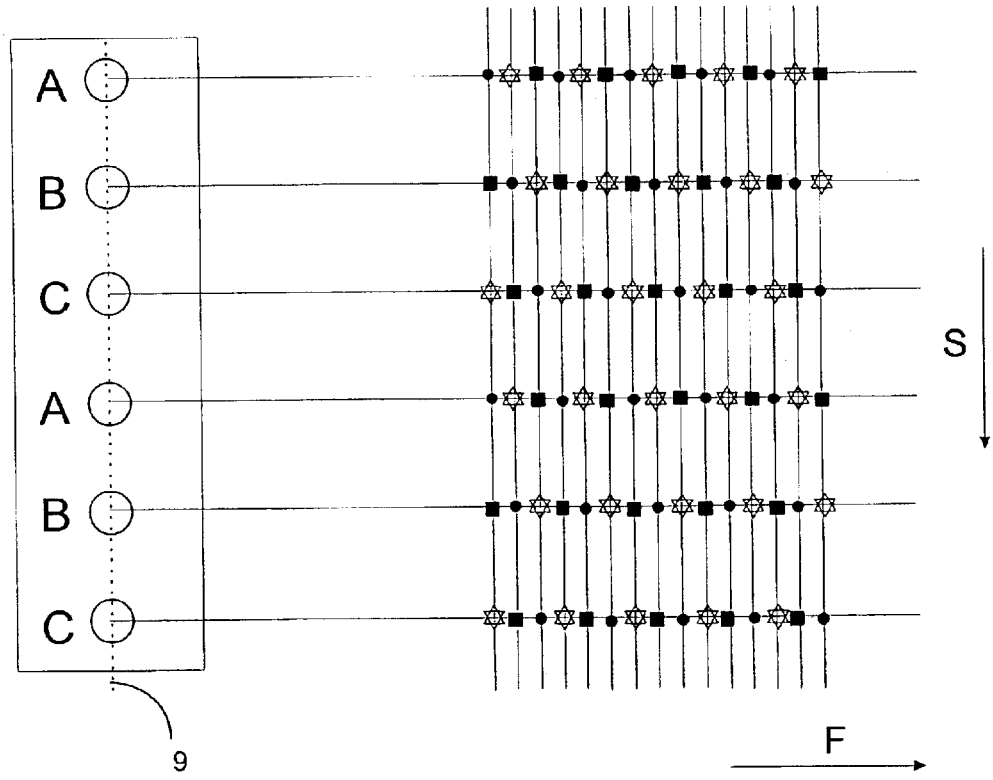
FIG. 5 schematically illustrates a printing scheme according to a further embodiment of the present invention using a printhead without nozzle stagger.

In a further embodiment, a printhead without nozzle stagger (i.e. all nozzles on a straight line 9, which forms a longitudinal axis of the head) is considered, as shown in FIG. 5. According to the present invention, the printing machine is set up so that adjacent nozzles of the printhead cannot fire at the same time. This is may be done either by software imposing that requirement, or it may be inherent to the printhead, for example when using a printhead with shared walls between adjacent nozzles.

Droplets will be fired (if needed, depending on the image to be printed), on positions calculated according to the following equations:

nozzles A will write at positions:

$$y_A = k.V.T$$

nozzles B will write at positions:

$$y_B = V \cdot T \cdot \frac{\varphi \cdot k + 1}{\varphi}$$

nozzles C will write at positions:

$$y_C = V \cdot T \cdot \frac{\varphi \cdot k + 2}{\varphi}$$

nozzles ϕ will write at positions:

$$y_\varphi = V \cdot T \cdot \frac{\varphi \cdot k + (\varphi - 1)}{\varphi}.$$

The resolution Y (pixels per inch) of the printed image can be calculated from the following equation:

$$\frac{0.0254}{Y} = y_B - y_A = \frac{V \cdot T}{\varphi}$$

thus $$Y = \frac{0.0254 \cdot \varphi}{V \cdot T}$$

The printing of a swath has to be repeated N times:

$$N = \frac{V \cdot T}{\left(\frac{V \cdot T}{\varphi}\right)} = \varphi$$

This means that by repeating the printing of a swath over a number of times equal to at least the number of nozzles in a group, any resolution can be printed with a head of the type mentioned above.

In FIG. 5 an example is given of a printhead without nozzle stagger, where there are 3 nozzles A, B, C in a group. Shared walls (not represented) between the nozzles prevent neighbouring nozzles from firing at the same moment. Dots indicated by circles are printed (or not, depending on the image content; but the nozzle is firable there) during a first pass, dots represented by squares are printed (or not, depending on the image content) during a second pass, and dots represented by stars are printed (or not, depending is on the image content) during a third pass. As can be seen from FIG. 5, after 3 passes the complete image is printed.

In the above embodiments, ABC firing is discussed. It is also possible to use CBA firing to obtain the correct higher resolution results according to the present invention. A skilled person can obtain the slightly modified equations.

Sixth Embodiment: Printer and Driver Software

Figure 6:
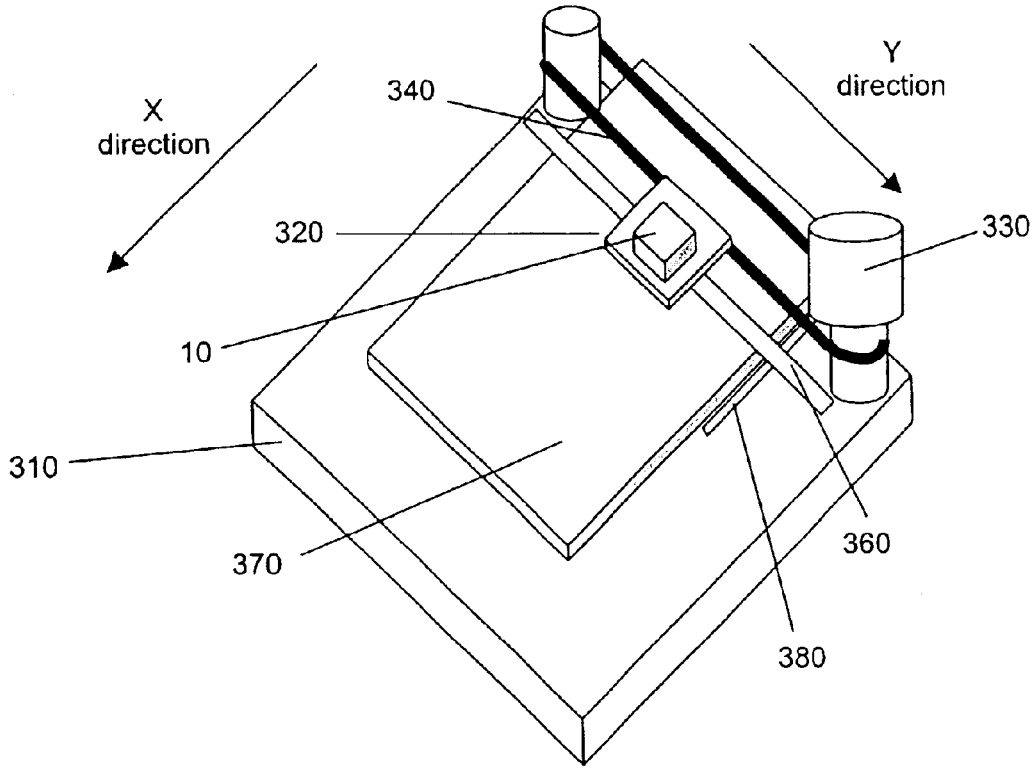
FIG. 6 is a highly schematic representation of an inkjet printer for use with the present invention.

FIG. 6 is a highly schematic general perspective view of an inkjet printer 200 which can be used with the present invention. The printer 200 includes a base 310, a carriage assembly 320, a step motor 330, a drive belt 340 driven by the step motor 330, and a guide rail assembly 360 for the carriage assembly 320. Mounted on the carriage assembly 320 is a printhead 10 that has a plurality of nozzles. The printhead 10 may also include one or more ink cartridges or any suitable ink supply system. A sheet of paper 370 is fed in the slow scan direction over a support 380 by a feed mechanism (not shown). The carriage assembly 320 is moved along the guide rail assembly 360 by the action of the drive belt 340 driven by the step motor 330 in the fast scanning direction.

Figure 7:
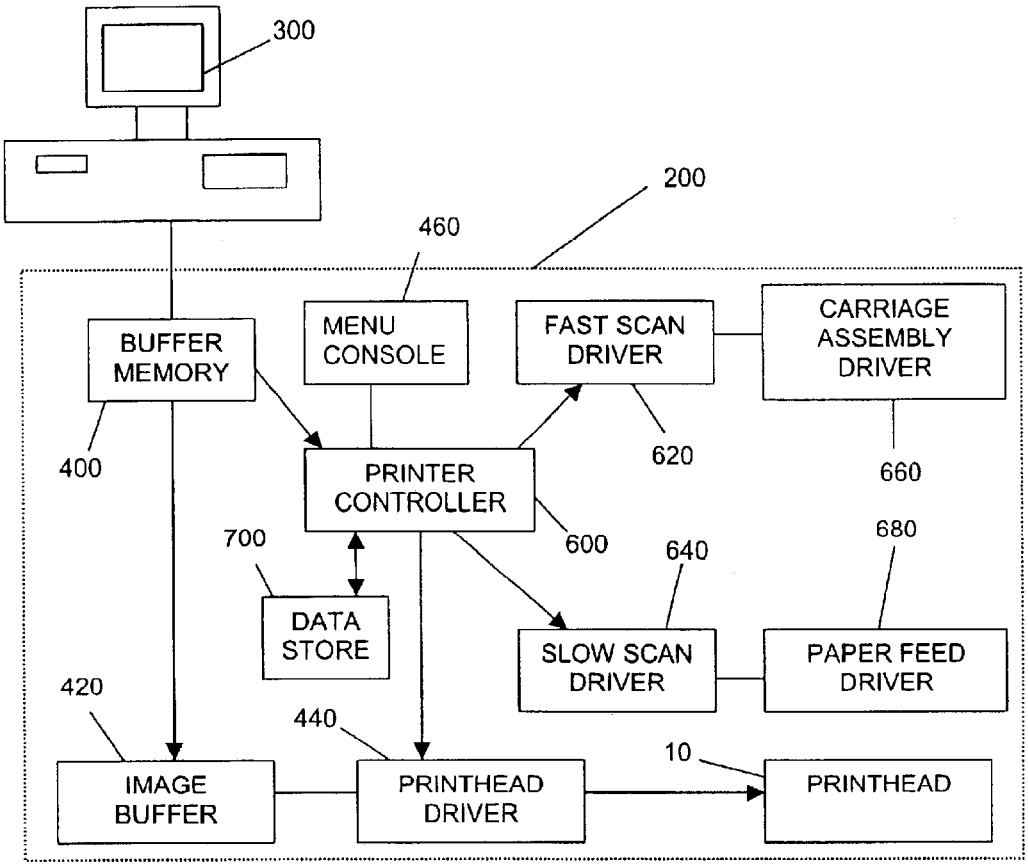
FIG. 7 is a schematic representation of a printer controller in accordance with an embodiment of the present invention.

FIG. 7 is a block diagram of the electronic control system of a printer 200, which is one example of a control system for use with a printhead 10 in accordance with the present invention. The printer 200 includes a buffer memory 400 for receiving a print file in the form of signals from a host computer 300, an image buffer 420 for storing printing data, and a printer controller 600 that controls the overall operation of the printer 200. Connected to the printer controller 600 are a fast scan driver 620 for a carriage assembly drive motor 660, a slow scan driver 640 for a paper feed drive motor 680, and a head driver 440 for the printhead 10. Optionally, there is a data store 700 for storing parameters for controlling the printing operation in accordance with the present invention. Host computer 300 may be any suitable programmable computing device such as personal computer with a Pentium III microprocessor supplied by Intel Corp. USA, for instance, with memory and a graphical interface such as Windows 98 as supplied by Microsoft Corp. USA. The printer controller 600 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA.

The user of printer 200 can optionally set values into the data store 700 so as to modify the operation of the printhead 10. The user can for instance set values into the data store 700 by means of a menu console 460 on the printer 200. Alternatively, these parameters may be set into the data store 700 from host computer 300, e.g. by manual entry via a keyboard. For example, based on data specified and entered by the user, a printer driver (not shown) of the host computer 300 determines the various parameters that define the printing operations and transfers these to the printer controller 600 for writing into the data store 700, e.g. the resolution. One aspect of the present invention is that the printer controller 600 controls the operation of printhead 10 in accordance with settable parameters stored in data store 700. Based on these parameters, the printer controller reads the required information contained in the printing data stored in the buffer memory 400 and sends control signals to the drivers 620, 640 and 440. In particular controller 600 is adapted for a dot matrix printer for printing an image on a printing medium, the control unit comprising software or hardware means for controlling printing of the image in multiple passes whereby in each pass parallel lines are printed at a non-zero angle with respect to the longitudinal axis of the printhead and also at a non-zero angle with respect to the fast scan direction, which series of parallel lines do not form a complete part of the image. When repeating printing passes in the fast scan direction, there is printed at intermediate positions between the parallel lines to print a complete part of the image. The control unit furthermore comprises software or hardware means for setting the resolution. The controller may be used for independently setting the resolution. As explained above the printhead has an array of marker elements under the control of the controller. For instance the controller may be adapted so that for a specific resolution the speed of the head in the fast scan direction is controlled. Resolutions may be selected by the user.

For instance, the printing data is broken down into the individual colour components to obtain image data in the form of a bit map for each colour component which is stored in the receive buffer memory 300. In accordance with control signals from the printer controller 600, the head driver 440 reads out the colour component image data from the image buffer memory 520 in accordance with a specified resolution to drive the speed and the array(s) of nozzles on the printhead 10 to achieve the required resolution.

As indicated above the controller 600 may be programmable, e.g. it may include a microprocessor or an FPGA. In accordance with embodiments of the present invention a printer in accordance with the present invention may be programmed to provide different resolutions. For example, the basic model of the printer may provide selection of one resolution only. An upgrade in the form of a program to download into the microprocessor or FPGA of the controller 600 may provide additional selection functionality, e.g. a plurality of resolutions. Accordingly, the present invention includes a computer program product which provides the functionality of any of the methods according to the present invention when executed on a computing device. Further, the present invention includes a data carrier such as a CD-ROM or a diskette which stores the computer product in a machine readable form and which executes at least one of the methods of the invention when executed on a computing device. Nowadays, such software is often offered on the Internet or a company Intranet for download, hence the present invention includes transmitting the printing computer product according to the present invention over a local or wide area network. The computing device may include one of a microprocessor and an FPGA.

The data store 700 may comprise any suitable device for storing digital data as known to the skilled person, e.g. a register or set of registers, a memory device such as RAM, EPROM or solid state memory.

While the invention has been shown and described with reference to a preferred embodiment, it will be understood by those skilled in the art that various changes or modifications in form and detail may be made without departing from the scope and spirit of this invention. For instance, the preparation for the printing file to carry out the above mentioned printed embodiments may be prepared by the host computer 300 and the printer 200 simply prints in accordance with this file as a slave device of the host computer 300. Hence, the present invention includes that the printing schemes of the present invention are implemented in software on a host computer and printed on a printer which carries out the instructions from the host computer without amendment. Accordingly, the present invention includes a computer program product which provides the functionality of any of the methods according to the present invention when executed on a computing device which is associated with a printhead, that is the printhead and the programmable computing device may be included with the printer or the programmable device may be a computer or computer system, e.g. a Local Area Network connected to a printer. The printer may be a network printer. Further, the present invention includes a data carrier such as a CD-ROM or a diskette which stores the computer product in a machine readable form and which can execute at least one of the methods of the invention when the program stored on the data carrier is executed on a computing device. The computing device may include a personal computer or a work station. Nowadays, such software is often offered on the Internet or a company Intranet for download, hence the present invention includes transmitting the printing computer product according to the present invention over a local or wide area network.

What is claimed is:

1. A multiresolution printing method for printing an image onto a printing medium using a printing system having an elongate printhead including an array of marking elements comprising at least one group G of $\phi$ marking elements which are staggered with respect to each other over a stagger distance D1 in a fast scan direction F, the marking elements forming a plurality of rows in a direction of a longitudinal axis of the printhead, the printhead being able to be operated at a reference velocity $V_{ref}$ to print images with a reference resolution X but actually being operated in the fast scan direction at an operating velocity V with $V/V_{ref}=RV\neq 1$ to allow the marking elements to print markings on the printing medium along a swath a during printing passes whereby the marking elements are fired at a predetermined constant time difference T and the maximum firing frequency is determined by a method comprising the steps of:

printing said markings along the swath on the printing medium during a first of the printing passes by firing adjacent said marking elements of one said group G at instants of time separated by time difference T thereby forming a partial image of the swath as a series of parallel lines of print at a non-zero angle with respect to both the longitudinal axis of the printhead and the fast scan direction, and printing additional said markings, during subsequent printing passes, at intermediate positions between the series of parallel lines of print to complete the image as determined by both the operating velocity V of the printhead, and the number of passes over each said swath, wherein the resolution Y of the printed image is given by $$Y = \frac{\varphi X}{|RV - 1|}.$$

2. The method according to claim 1 wherein the printhead uses common wall technology.

3. The method according to claim 1, the method including delaying printing data representing the image supplied to some of the marking elements with respect to the printing data supplied to other marking elements.

4. The method according to claim 1, furthermore comprising shifting the printing medium with respect to the printhead between printing passes.

5. The method according to claim 1, comprising the steps of driving the printhead at a first velocity to print at a first resolution and then driving the printhead at another different velocity to print at a second different resolution.

6. The method according to claim 1, wherein the operating velocity of driving the printhead is faster than the reference velocity.

7. The method according to claim 1, wherein the operating velocity of driving the printhead is slower than the reference velocity.

8. A multiresolution printing method for printing an image onto a printing medium using a printing system having an elongate printhead including an array of marking elements comprising at least one group G of $\phi$ marking elements which are staggered with respect to each other over a stagger distance D1 in a fast scan direction F, the marking elements forming a plurality of rows in a direction of a longitudinal axis of the printhead, the printhead being operable at a reference velocity $V_{ref}$ to print images with a reference resolution X but being operated in the fast scan direction at an operating velocity V with $V/V_{ref}=RV\neq 1$ to allow the marking elements to print markings on the printing medium along a swath during printing passes whereby the marking elements are fired at a predetermined constant time difference T and the maximum firing frequency is determined by a method comprising the steps of:

printing said markings along the swath on the printing medium during a first of the printing passes by firing adjacent said marking elements of one said group G at instants of time separated by time difference T thereby forming a partial image of the swath as a series of parallel lines of print at a non-zero angle with respect to both the longitudinal axis of the printhead and the fast scan direction, and printing additional said markings, during subsequent printing passes, at intermediate positions between the series of parallel lines of print to complete the image as determined by both the operating velocity V of the printhead, and the number of passes over each said swath, wherein the number of repeating printing passes is given by $$N = \frac{\varphi RV}{|RV - 1|}.$$

9. The method according to claim 8, wherein the operating velocity of driving the printhead is faster than the reference velocity.

10. The method according to claim 8, wherein the operating velocity of driving the printhead is slower than the reference velocity.

11. The method according to claim 8 wherein the printhead uses common wall technology.

12. The method according to claim 8, further comprising the step of delaying printing data representing the image supplied to some of the marking elements with respect to the printing data supplied to other marking elements.

* * * * *